US008291827B2

(12) United States Patent
Mellor et al.

(10) Patent No.: US 8,291,827 B2
(45) Date of Patent: Oct. 23, 2012

(54) ROCKET GUIDANCE ADAPTER

(75) Inventors: Timothy B. Mellor, Tucson, AZ (US); Eric Brogmus, Tucson, AZ (US); George E. Dunn, Jr., Vail, AZ (US); Patrick Willems, Tucson, AZ (US); Mark L Sedig, Derringer, AZ (US)

(73) Assignee: Raytheon Company, Waltham, MA (US)

( * ) Notice: Subject to any disclaimer, the term of this patent is extended or adjusted under 35 U.S.C. 154(b) by 340 days.

(21) Appl. No.: 12/567,800

(22) Filed: Sep. 28, 2009

(65) Prior Publication Data

US 2012/0205487 A1 Aug. 16, 2012

(51) Int. Cl.
*C06C 5/00* (2006.01)

(52) U.S. Cl. ..... 102/275.9

(58) Field of Classification Search ..... 102/275.9
See application file for complete search history.

(56) References Cited

U.S. PATENT DOCUMENTS

| | | | | |
|---|---|---|---|---|
| 918,560 | A * | 4/1909 | Lanneau | 102/200 |
| 1,531,716 | A * | 3/1925 | Remondy | 102/272 |
| 8,069,790 | B1 * | 12/2011 | Melkers | 102/275.9 |

FOREIGN PATENT DOCUMENTS

| | | | |
|---|---|---|---|
| EP | 1688702 | A1 | 8/2006 |
| FR | 2845763 | A1 | 4/2004 |
| FR | 2910613 | A1 | 6/2008 |
| WO | 2009020697 | A2 | 2/2009 |

* cited by examiner

*Primary Examiner* — Michael Carone
*Assistant Examiner* — Reginald Tillman, Jr.
(74) *Attorney, Agent, or Firm* — Eric A. Gifford

(57) ABSTRACT

A two-piece adapter for mounting a guidance system on unguided rockets allows for the existing designs and stores of unguided rockets to be retrofitted with guidance capability to provide a "guided rocket". The adapter provides the external mounting features for mounting the guidance system and does so in a manner that transfers the steering loads of the guidance system to the rocket airframe and maintains the proper preloading and relationship of the fuze-to-warhead to detonate the warhead. The two-piece adapter comprises an inner adapter and an outer adapter. The inner adapter is secured between the fuze and warhead without requiring modifications of either part and provides the external mounting feature. The outer adapter is secured to the inner adapter and effectively moves the external mounting feature forward in front of the fuze where the guidance system is attached.

21 Claims, 8 Drawing Sheets

ROCKET GUIDANCE ADAPTER

BACKGROUND OF THE INVENTION

1. Field of the Invention

This invention relates to adapting guidance systems to retrofit unguided rockets.

2. Description of the Related Art

Unguided ordnance cannot be steered toward a target and thus exhibit limited lethality. Unguided ordnance also pose considerable collateral damage concerns surrounding their use, particular in urban or "danger close" battlefield situations where friendly forces are in close proximity with enemy combatants. Such ordnance includes artillery and other tube-launched projectiles all of which will be referred to herein as "rockets".

As shown in FIGS. 1*a* and 1*b*, an unguided 2.75" Hydra-70 rocket 10 is one example of unguided ordnance. The Hydra-70 rocket includes propellant 12 inside a cylindrical airframe 14, a tail assembly 16 that includes a nozzle 18 and fins 20 that deploy to a fixed position upon clearing the launch tube, an explosive warhead 22 and a fuze 24 on the end of the warhead. The fuze includes an external thread form 26 that mates with the warhead's internal thread form 28 to form a threaded interface. Torque is applied to the fuze to drive a fuze lip 30 into the warhead to create an axial load to "preload" the fuze. When launched, the Hydra-70 rocket is spin-stabilized to fly unguided toward a target. Upon impact an initiation charge in fuze 24 transfers energy to the warhead to detonate a primary charge.

Laser, RF, infrared or Global Positioning System/Inertial Navigation System (GPS/INS) guided ordnance is commonly used to engage point targets with a high probability of success and minimal collateral damage. Such ordnance includes guided artillery and other tube-launched projectiles, all of which will be referred to herein as "missiles". A laser guided missile typically includes a semi-active laser (SAL) seeker to detect laser radiation scattered from the intended target and to provide signals indicative of the target bearing to actuate aero-dynamic surfaces to guide the missile to the target. IR guided missiles sense the infrared radiation emitted from the target to guide the missile. A GPS/INS guided missile uses GPS updates of missile position, heading and velocity to guide the missile to mensurated coordinates programmed into the missile.

Guidance systems can be developed to retrofit unguided rockets to increase the lethality and decrease the collateral damage for the existing design and stores of unguided rockets. However, there are typically no external features present on the rockets to which the guidance systems can be attached in order to accomplish the retrofitting for "guided rockets".

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an adapter for mounting a guidance system on unguided rockets. The invention allows the existing design and stores of unguided rockets to be retrofitted with guidance capability to provide a "guided rocket". The adapter provides the external mounting features for mounting the guidance system, transfers the steering loads of the guidance system to the rocket airframe and maintains the proper preloading and geometric relationship of the fuze-to-warhead to detonate the warhead. The adapter is a two-piece design comprised of an inner adapter and an outer adapter. The inner adapter is secured between the fuze and warhead without requiring modifications of either part and provides the external mounting feature. The outer adapter is secured to the inner adapter and effectively moves the external mounting feature forward in front of the fuze where the guidance system is attached.

In an embodiment, a guided rocket comprises an unguided rocket, an adapter secured to the rocket and a guidance system mounted on the adapter. The unguided rocket comprises a warhead having an inner thread form and a fuze having an outer thread form. The guidance system includes an aft mounting feature and one or more canards for steering the rocket. The adapter comprises an inner adapter with an outer thread form and an outer adapter with an inner thread form. The inner adapter is captured between the fuze and the warhead at a first threaded interface. The outer adapter's inner thread form is threaded on the inner adapter's outer thread form at a second threaded interface. The outer adapter comprises an external mounting feature forward of the fuze to which the guidance system's aft mounting feature is attached. The external mounting feature may, for example, be a thread form or a radial screw joint. The outer adapter may be integrally formed with the guidance system in which case its inner thread form provides the aft mounting feature.

In an embodiment, a guided rocket comprises an unguided rocket, an adapter secured to the rocket and a guidance system mounted on the adapter. The unguided rocket comprises a warhead having an inner thread form and a fuze having an after outer thread form with a lip. The guidance system includes an aft mounting feature and one or more canards to steer the rocket. The adapter comprises an inner adapter with an inner surface configured to match the exterior profile of the warhead, a forward face and an all outer thread form and an outer adapter with an aft wall, an inner thread form, a center cavity, and an external mounting feature forward of the center cavity. The inner adapter's forward face is captured between the fuze lip and the warhead at a first threaded interface so that the inner adapter's inner surface makes conformal contact with the warhead to preload the fuze. The outer adapter's inner thread form is threaded on the inner adapter's outer thread form at a second threaded interface so that the aft wall contacts and preloads against the warhead all of the inner adapter and the fuze is positioned within the center cavity. The outer adapter's external mounting feature is positioned forward of the fuze to which the guidance system's aft mounting feature is attached. The second threaded interface and the aft wall transfer steering loads from the canards through the adapter to the rocket.

In an embodiment, the guided rocket is assembled by first providing a partially-assembled unguided rocket including a warhead having an inner thread form. An inner adapter having an inner surface configured to match the exterior profile of the warhead is placed over the warhead, the inner adapter having a forward face and an aft outer thread form. A fuze having an outer thread form with a lip is threaded into the warhead's inner thread form so that the lip captures the inner adapter's forward face causing the inner surface to make conformal contact with the warhead to preload the fuze. An outer adapter having an aft wall, an inner thread form, a center cavity, and an external mounting feature forward of said center cavity is threaded onto the inner adapter's outer thread form so that the aft wall contacts and preloads against the warhead aft of the inner adapter to position the fuze within the center cavity and position the external mounting feature forward of the fuze. A guidance system is mounted onto the external mounting feature.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
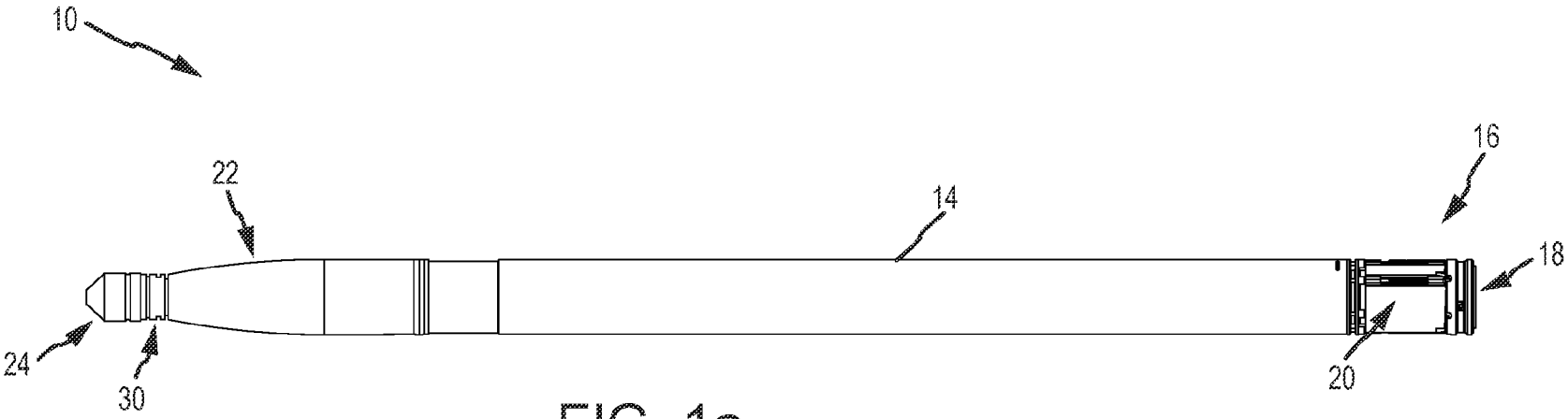
FIG. 1a (PRIOR ART)
FIGS. 1*a* and 1*b*, described above, are side and section views of an unguided 2.75" Hydra-70 rocket.
Figure 1B:
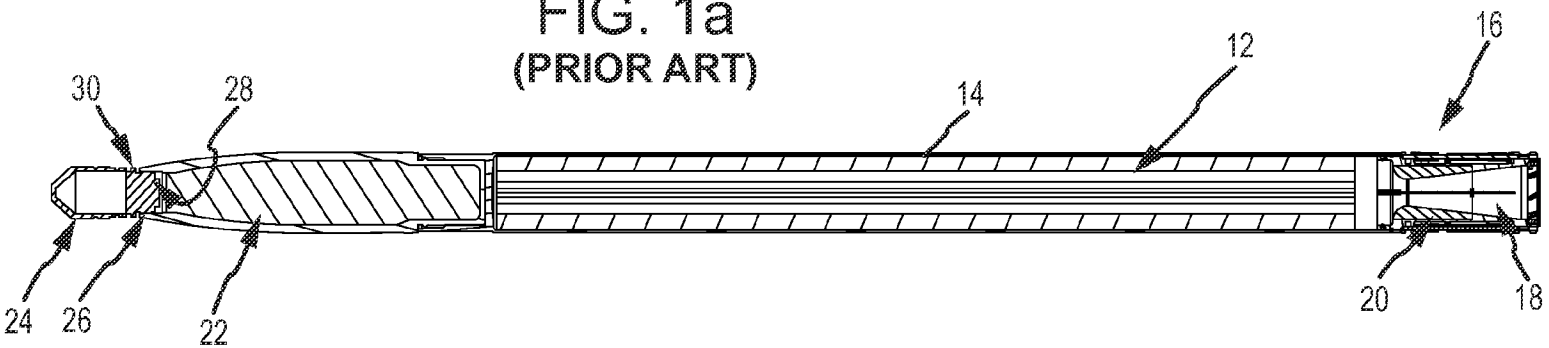
FIG. 1b (PRIOR ART)
Figure 2A:
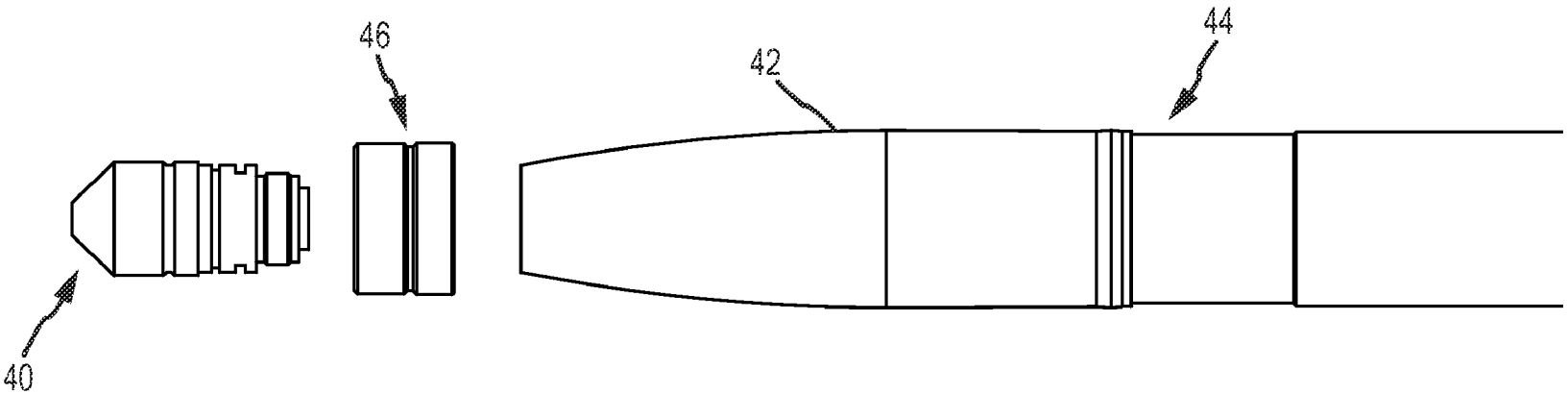
FIGS. 2*a* and 2*b* are side and section exploded views of the first stage of assembly of a guided rocket including an inner adapter.
Figure 2B:
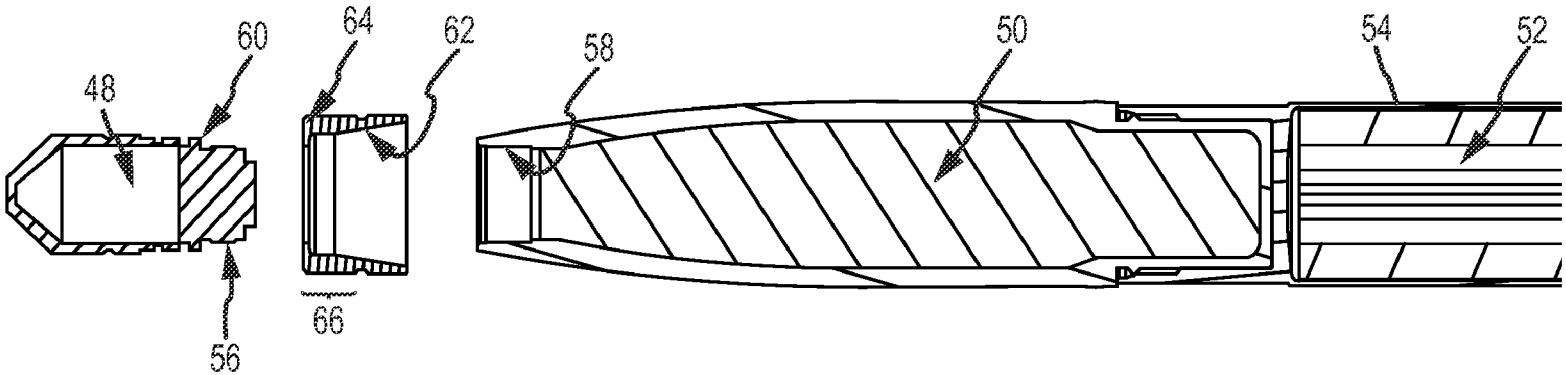
Figure 3A:
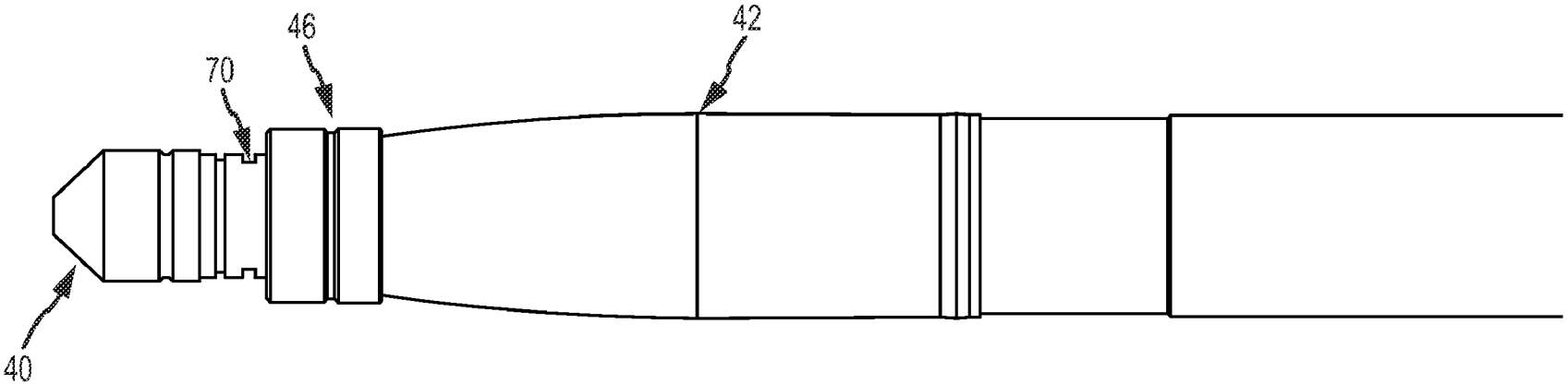
FIGS. 3*a* and 3*b* are side and section views of the final assembly of the inner adapter captured longitudinally between the fuze and the warhead.
Figure 3B:
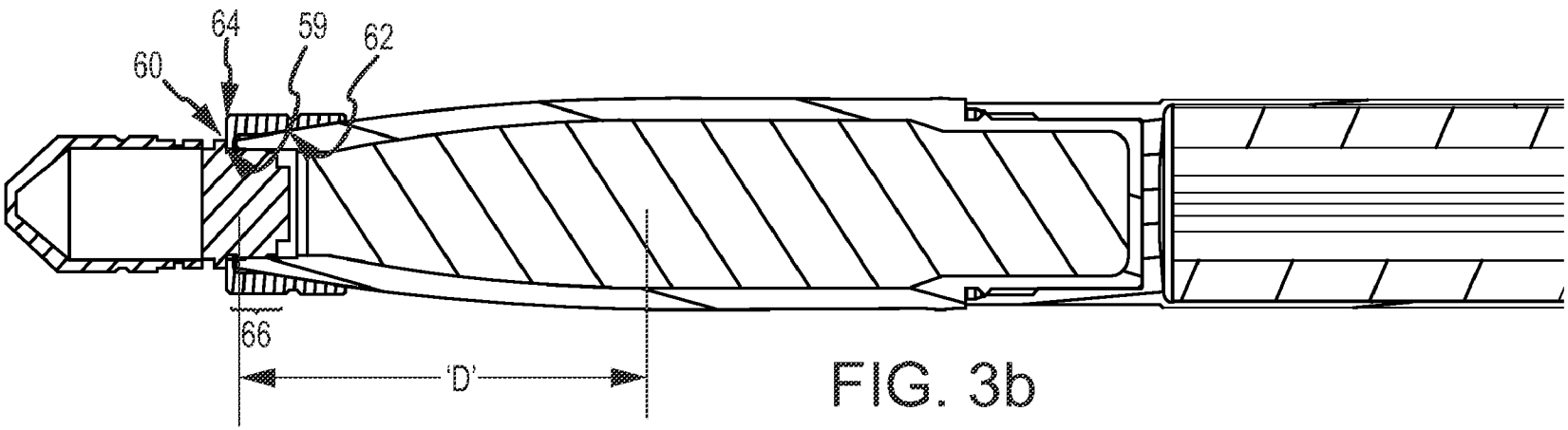
Figure 4A:
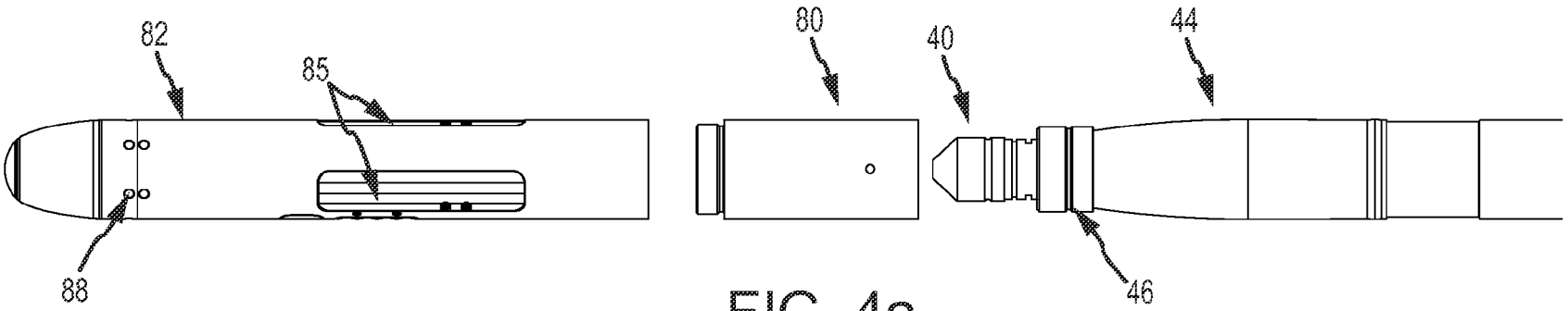
FIGS. 4*a* and 4*b* are side and section exploded views of an outer adapter and guidance system.
Figure 4B:
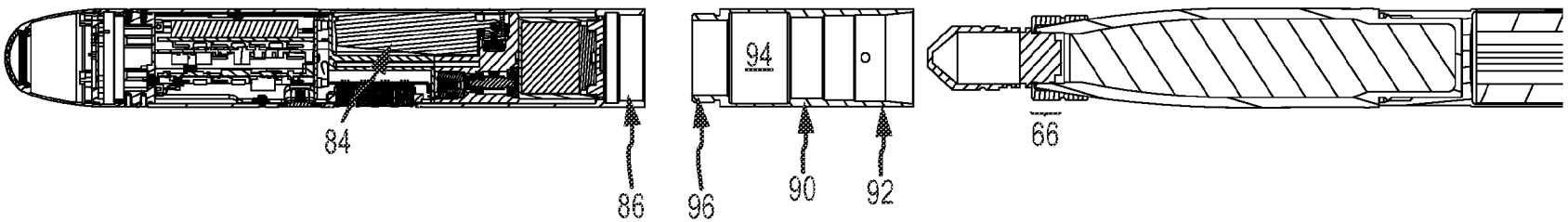
Figure 5A:
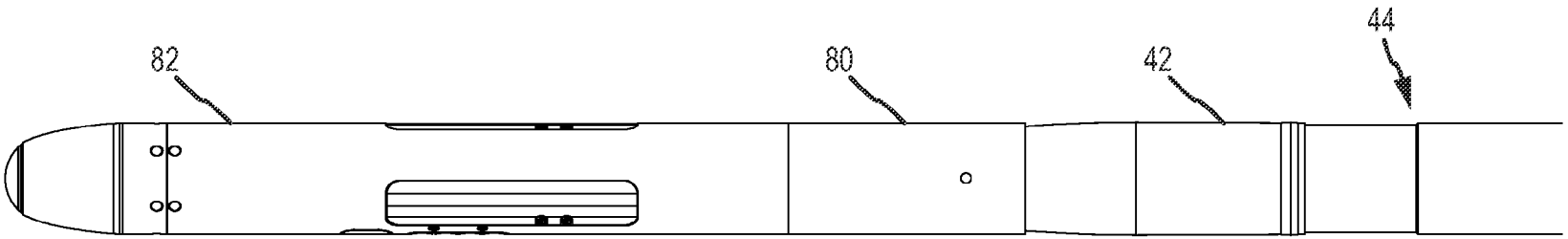
FIGS. 5*a* and 5*b* are side and section views of the final assembly of the outer adapter and guidance system.
Figure 5B:
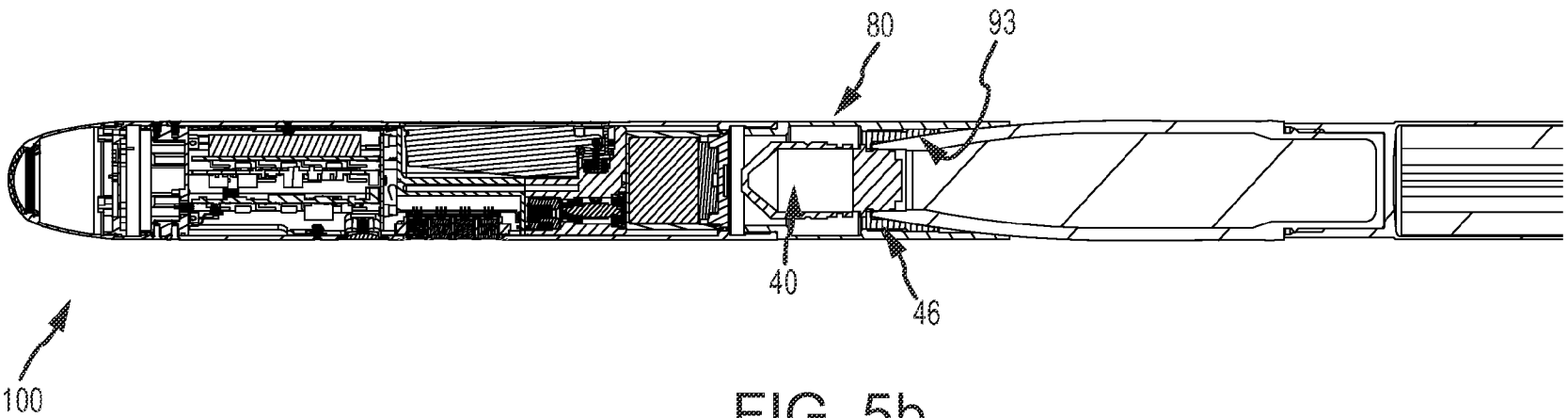

The present invention describes a two-piece adapter for mounting a guidance system on unguided rockets to create a "guided rocket". The invention allows the existing designs and stores of unguided rockets to be retrofitted with guidance capability to provide a "guided rocket". The adapter provides the external mounting features for mounting the guidance system and does so in a manner that transfers the steering loads of the guidance system to the rocket airframe and maintains the proper preloading and relationship of the fuze-to-warhead to detonate the warhead. The two-piece adapter comprises an inner adapter and an outer adapter. The inner adapter is secured between the fuze and warhead without requiring modifications of either part and provides the external mounting feature. The outer adapter is secured to the inner adapter and effectively moves the external mounting feature forward in front of the fuze where the guidance system is attached.

Without loss of generality, the two-piece adapter will be described for mounting a laser guidance system to a 2.75" Hydra-70 rocket that uses an impact fuze (M423 fuze installation) to initiate detonation of the main warhead (high explosive Mk-151 warhead). It will be understood by those of ordinary skill in the art that the adapter may be used with different guidance systems and different unguided rockets without departing from the scope of the invention. For example, the guidance system could use passive IR sense capability, a dual-mode laser and IR capability, RF or GPS/INS. The rocket may be another 2.75" design of which there are several utilizing impact fuzes with different warheads. The two-piece adapter may be scaled to larger rockets. The rocket may be configured for use with other fuzes such as proximity or g-force.

The first stage of assembly of the guided rocket is illustrated in FIGS. 2*a*-2*b* and 3*a*-3*b*. The existing fuze 40 is removed from the warhead 42 of unguided rocket 44 to allow introduction of an inner adapter 46. The fuze and warhead include an initiator charge 48 and primary charge 50, respectively. The rocket also includes propellant 52 inside an airframe 54 and a tail assembly (not shown). The fuze includes an external thread form 56 that is configured to mate with the warhead's internal thread form 58 ("fuze well") to form a threaded interface 59. The fuze also includes a lip 60 just forward of the external thread form 56. The unguided rocket has no external mounting features to which the guidance system's aft mounting feature can be attached Inner adapter 46 may include an inner surface 62, a forward face 64 and an outer thread form 66. Inner surface 62 is designed to match the exterior profile of the existing warhead. In this example, the shape is tailored to the Mk-151 warhead. However, this profile can be altered to accommodate any shape warhead. Forward face 64 is positioned relative to the inner surface such that, upon assembly, the fuze lip 60 will capture the forward face 64 and secure the inner adapter between the fuze and the warhead. The forward face is thick enough to sustain the preload forces and thin enough to maintain the position of the fuze with respect to the warhead for proper initiation of the warhead by the fuze. For the Hydra-70 rocket the forward surface may, for example, be 0.050 to 0.125 inches thick. Outer thread form 66 creates the external mounting feature that is missing from the baseline Hydra-70 rocket which now allows for the attachment of a guidance system.

Inner adapter 46 is sized so that the existing fuze threads are able to engage the fuze well within the forward tip of the warhead 42. Inner adapter 46 is positioned aft of the fuze so that standard, existing tools can engage one or more engagement surfaces 70 on the fuze from the side and apply the required torque. As torque is applied to the fuze, fuze lip 60 captures forward face 64 to drive inner adapter 46 onto the warhead to preload the fuze. The inner adapter makes conformal contact all along its inner surface 62. The final assembly position is designed to ensure proper spacing 'd' of the fuze and warhead. The inner adapter 46 is now captured longitudinally between the aft face on the fuze 40 and the warhead 42. Radial forces between the inner surface 62 and warhead tend to expand the outer thread form 66. This distortion is controlled so that the thread form 66 is still usable as an attachment interface for the guidance system. Thread form distortion due to pre-load is controlled by inner surface contour, wall thickness, and position of forward face.

The second stage of assembly of the guided rocket is illustrated in FIGS. 4*a*-4*b* and 5*a*-5*b*. With the inner adapter 46 providing an external thread form 66, an outer adapter 80 is introduced which exploits this outer thread form to allow the attachment of a guidance system 82 in front of fuze 40. Guidance system 82 controls actuators that deploy canards 84 (stored beneath covers 85) to steer the rocket. The guidance system may use laser designation, RF designation, passive IR or GPS/INS or a combination thereof to determine the bearing to target and generate the flight control signals to control the actuators. Guidance system 82 includes an aft mounting feature 86 for attachment to outer adapter 80. In this embodiment, the mounting feature 86 is an inner thread form. The feature could be an outer thread form or a plurality of radial screws around the circumference such as the radial screws 88 used to form a radial screw joint to secure the seeker assembly. Alternately, the outer adapter 80 could be integrally formed on the aft section of the guidance system.

Outer adapter 80 may include an inner thread form 90, an aft wall 92, a center cavity 94 and an external mounting feature 96. Inner thread form 90 is a mating thread to the outer thread form 66 on the inner adapter 46 to form a threaded interface 93 to provide load transfer. The inner thread form is positioned within the outer adapter such that the aft wall 92 of the outer adapter contacts and pre-loads against the warhead. Aft wall 92 is dimensioned such that forces of pre-load deform it minimally in the outward direction to maintain the required 2.75" outer dimension (required to interface with fielded launchers), while engaging enough length to provide load transfer. Center cavity 94 accommodates therein the size and shape of the existing fuze 40. For an impact fuze, the center cavity has a wall thickness such that it will collapse appropriately upon target impact, which allows fuze initiation. In this embodiment, external mounting feature 96 is an outer thread form that forms a third threaded interface with the guidance system's inner thread form.

Upon completion of the first and second stages of assembly the unguided rocket 44 has been retro-fitted with a guidance system 82 by use of inner adapter 46 and outer adapter 80 to create a guided rocket 100. The basic elements of the unguided Hydra-70 rocket are all maintained in a functional arrangement while now allowing for the adaptation of a guidance system which increases its lethality and decreases the potential to create collateral damage within the battle space. The two-piece adapter maintains the proper geometric relationship of the fuze and warhead to preload the fuze and to transfer energy from the fuze to the warhead upon initiation to detonate the warhead. The two-piece adapter does not interfere with the standard insertion of the fuze into the fuze well in the warhead and application of torque. Furthermore, the two-piece warhead provides a stiff joint or interface that efficiently transfers steering loads from the canards to the airframe.

The adapter also provides for a body fixed sensor configuration so that rotation of the All-Up Round, a functional element of the basic Hydra-70 rocket, is transferred to the guidance system. The two points of contact established at the Inner Adapter-warhead and the Outer Adapter-warhead locations provide a stiff and stable mounting arrangement which is necessary to minimize vibration and resultant distortion of the seeker image while the rocket is guided to the target.

Figure 6:
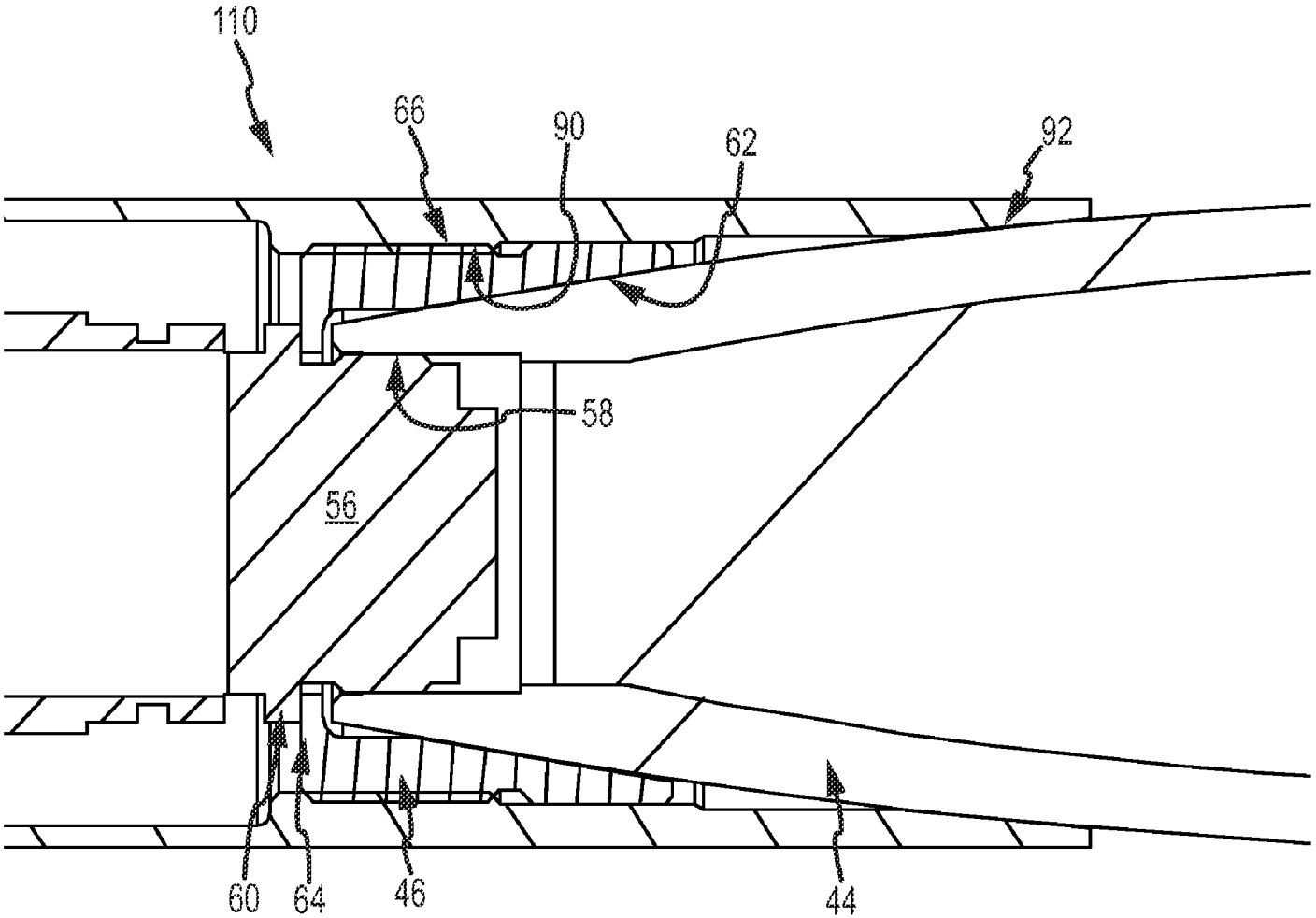
FIG. 6 is a section view of the inner-to-outer adapter joint.

The inner adapter-to-outer adapter joint 110 is shown in more detail in FIG. 6. A stiff and stable foundation is formed as fuze threads 56 engage fuze well 58 by the fuze lip 60 driving the forward face 64 of the inner adapter 46 into the warhead 44 such that the inner adapter makes conformal contact all along its inner surface 62 with the exterior profile of the warhead and preloads the fuze. The forward face is thick enough to withstand the preload forces yet thin enough not to disturb the geometric relationship of the fuze and warhead to initiate detonation. The outer adapter's inner thread form 90 engages the outer thread form 66 of the inner adapter. The inner thread form 90 is positioned within the outer adapter such that the aft wall 92 of the outer adapter contacts and pre-loads against the warhead 44. The two threaded interfaces and the direct contact of the aft wall to the warhead together function to transfer rotation of the rocket to the guidance system and steering forces from the guidance system to the rocket airframe.

Figure 7:
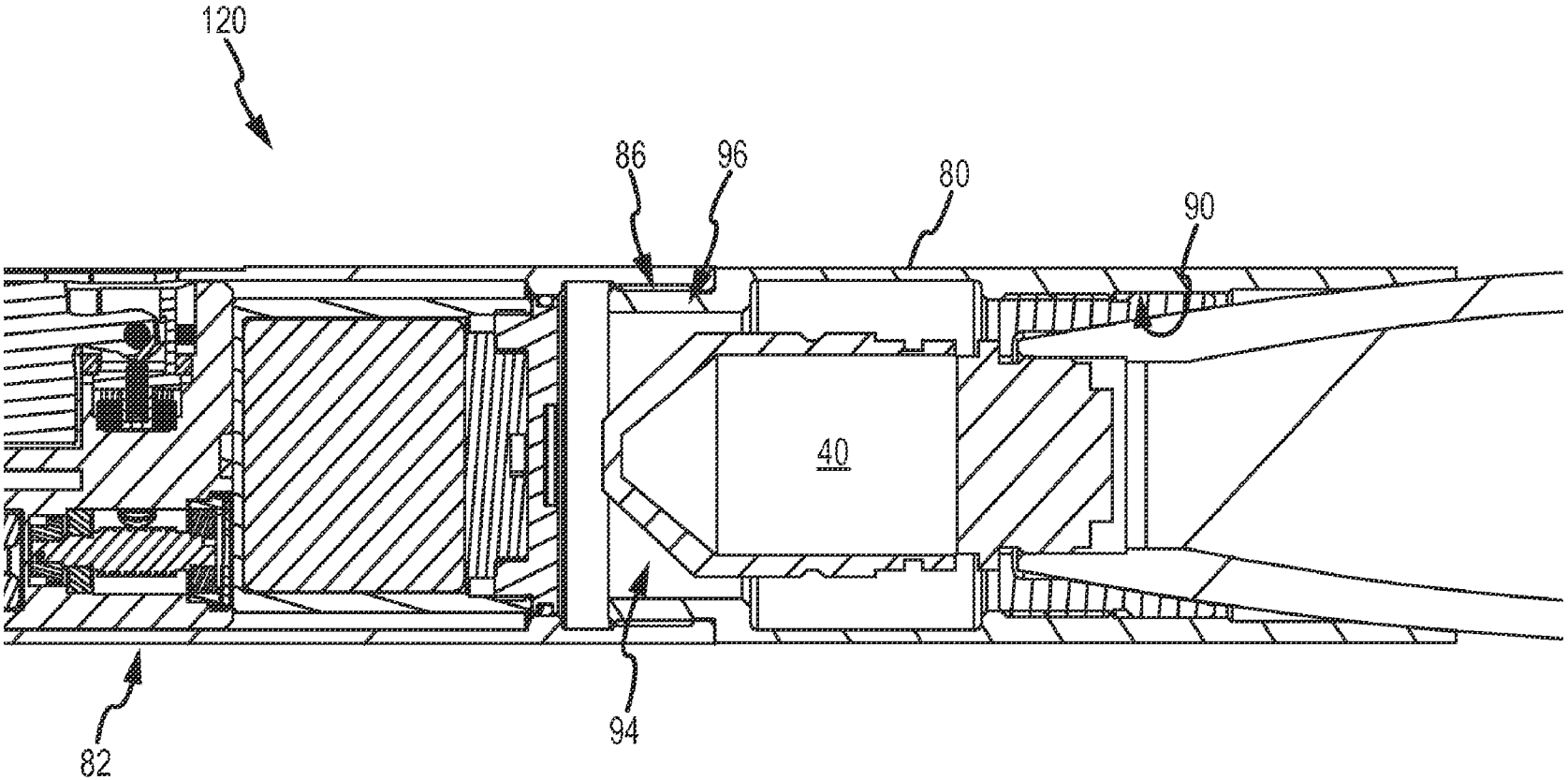
FIG. 7 is a section view of the outer adapter-to-guidance system joint.

The outer adapter-to-guidance system joint 120 is shown in more detail in FIG. 7. The fuze 40 is accommodated within the central cavity 94 of outer adapter 80. The outer adapter's outer thread form 96 forms a third threaded interface with the guidance system's inner thread form 86 to attach the guidance system 82 forward of fuze 40. Alternately, radial screws around the circumference of the airframe through the outer wall of the guidance system and inner wall of the outer adapter (or vice-versa) to form a radial screw joint or other means may be employed to attach the guidance system to the outer adapter. Alternately, the outer adapter 80 may be integrally formed with the guidance system in which case the inner thread form 90 becomes the guidance system's aft mounting feature.

Figure 8:
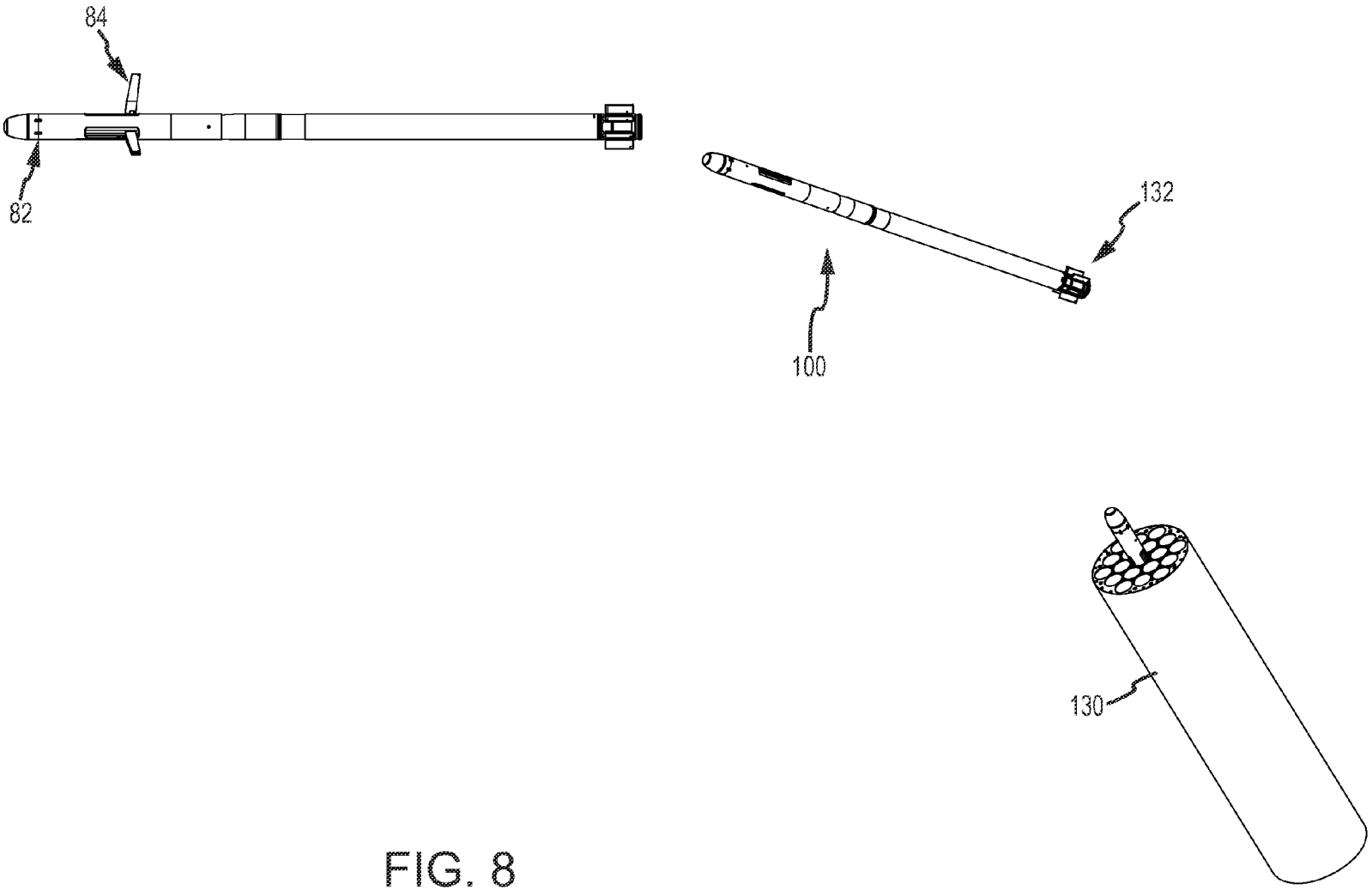
FIG. 8 is a diagram of a launch sequence of the guided rocket to engage a target.

An exemplary launch of guided rocket 100 is depicted in FIG. 8. Guided rocket 100 is stored in an existing multi-tube launch platform 130 used for unguided Hydra-70 rockets. The rocket's motors ignite and, upon clearing the launch tube, the tail assembly deploys fins 132 to their fixed position. The rocket is spin-stabilized for the first part of its flight (unguided). At some point, the guidance system 82 is activated and canards deployed to stop the rocket from spinning and steer the rocket for the terminal part of its flight (guided) to the target. As described above, in addition to providing external mounting features on which to attach the guidance system to be effective the two-piece adapter maintains the preload of the fuze and the geometric relationship of the fuze to the warhead and efficiently transfers loads between the rocket airframe and guidance system. The two-piece adapter provides a reliable and cost-effective solution for retrofitting unguided rockets to become "guided rockets" to both improve their lethality and to reduce collateral damage.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A guided rocket, comprising:

an unguided rocket including a warhead having an inner thread form and a fuze having an outer thread form configured to mate with the warhead's inner thread form to form a first threaded interface, said fuze having a lip forward of the outer thread form and one or more engagement surfaces forward of the lip and outer thread form;

a guidance system including an aft mounting feature and one or more canards; and;

an adapter comprising an inner adapter with an inner surface configured to match the exterior profile of the warhead, a forward end having front and back surfaces, and an aft outer thread form and an outer adapter with an inner thread form, said fuze lip contacting the front surface of the inner adapter's forward end such that the back surface contacts the warhead to capture the inner adapter between the fuze lip and the warhead aft of the engagement surfaces so that the inner adapter's inner surface makes conformal contact with the exterior profile of the warhead to preload the fuze, said outer adapter's inner thread form threaded on the inner adapter's outer thread form at a second threaded interface, said outer adapter comprising an external mounting feature forward of said fuze to which the guidance system's aft mounting feature is attached.

2. The guided rocket of claim 1, wherein said inner adapter makes conformal contact all along its inner surface with the exterior profile of the warhead.

3. The guided rocket of claim 1, wherein only said fuze lip engages the forward end to capture the inner adapter and preload the fuze.

4. The guided rocket of claim 3, wherein said forward end sustains the preload forces and maintains the position of the fuze with respect to the warhead for proper initiation of the warhead by the fuze.

5. The guided rocket of claim 1, wherein the fuze's one or more engagement surfaces positioned forward of its outer thread form provide for engagement by a tool to torque the fuze into the warhead's inner thread form to form the first threaded interface.

6. The guided rocket of claim 1, wherein said outer adapter comprises an aft wall that contacts and pre-loads against the warhead aft of the inner adapter, said outer adapter's aft wall extending aft from the inner adapter engaging a length of the warhead aft of the inner adapter and second threaded interface to provide load transfer.

7. The guided rocket of claim 1, wherein said outer adapter comprises a center cavity configured to accommodate the fuze therein.

8. The guided rocket of claim 7, wherein the fuze is an impact fuze, said center cavity having a wall thickness that collapses upon target impact to initiate the fuze.

9. The guided rocket of claim 1, wherein the outer adapter's external mounting feature comprises a thread form.

10. The guided rocket of claim 1, wherein the outer adapter's external mounting feature comprises a radial screw joint.

11. The guided rocket of claim 1, wherein the outer adapter is formed integrally with the guidance system and its inner thread form defines the guidance system's aft mounting feature.

12. The guided rocket of claim 1, wherein said unguided rocket has no external mounting features to which the guidance system's aft mounting feature can be attached.

13. A guided rocket, comprising:

an unguided rocket including a warhead having an inner thread form and a fuze having an aft outer thread form, a lip forward of the outer thread form and one or more engagement surfaces forward of the lip and outer thread form for engagement by a tool to torque the fuze into the warhead's inner thread form to form a first threaded interface;

a guidance system including an aft mounting feature and one or more canards to steer the rocket; and an adapter comprising an inner adapter with an inner surface configured to match the exterior profile of the warhead, a forward end having front and back surfaces, and an aft outer thread form and an outer adapter with an aft wall, an inner thread form, a center cavity and an external mounting feature forward of said center cavity, said fuze lip contacting the front surface of the inner adapter's forward end such that the back surface contacts the warhead to capture the inner adapter between the fuze lip and the warhead aft of the engagement surfaces so that the inner adapter's inner surface makes conformal contact with the warhead to preload the fuze, said outer adapter's inner thread form threaded on the inner adapter's outer thread form at a second threaded interface so that the outer adapter's aft wall extends aft from the inner adapter engaging a length of the warhead and preloads against the warhead aft of the inner adapter and the fuze is positioned within the center cavity, said outer adapter's external mounting feature forward of said fuze to which the guidance system's aft mounting feature is attached, said second threaded interface and said aft wall transferring steering loads from the canards through the adapter to the rocket.

14. The guided rocket of claim 13, wherein the outer adapter's external mounting feature comprises a thread form.

15. The guided rocket of claim 13, wherein said unguided rocket has no external mounting features to which the guidance system's aft mounting feature can be attached.

16. An adapter for mounting a guidance system on an unguided rocket including a warhead having an inner thread form and a fuze having an aft outer thread form, a lip and one or more engagement surfaces forward of the lip and outer thread form for engagement by a tool to torque the fuze into the warhead's inner thread form to form a first threaded interface, said adapter comprising:

an inner adapter with an inner surface configured to match the exterior profile of the warhead, a forward end having front and back surfaces, and an aft outer thread form; and an outer adapter with an aft wall, an inner thread form, a center cavity and an external mounting feature forward of said center cavity, said inner adapter's forward end's front and back surfaces configured for contacting the fuze lip and the warhead, respectively, to capture the inner adapter between the fuze lip and the warhead aft of the engagement surfaces so that the inner adapter's inner surface makes conformal contact with the warhead to preload the fuze, said outer adapter's inner thread form configured to thread onto the inner adapter's outer thread form at a second threaded interface so that the outer adapter's aft wall extends aft from the inner adapter engaging a length of the warhead and preloads against the warhead aft of the inner adapter to position the fuze within the center cavity, said outer adapter's external mounting feature forward of said fuze for attachment to the guidance system's aft mounting feature.

17. The adapter of claim 16, wherein the outer adapter's external mounting feature comprises a thread form.

18. The adapter of claim 16, wherein said unguided rocket has no external mounting features to which the guidance system's aft mounting feature can be attached.

19. A method of assembling a guided rocket, comprising:

providing a partially-assembled unguided rocket including a warhead having an inner thread form;

placing an inner adapter having an inner surface configured to match the exterior profile of the warhead over the warhead, said inner adapter having a forward end having front and back surfaces, and an aft outer thread form;

threading a fuze having an outer thread form with a lip into the warhead's inner thread form so that the lip contacts the front surface of the inner adapter's forward end such that the back surface contacts the warhead to capture the inner adapter between the fuze lip and the warhead and the inner surface makes conformal contact with the warhead to preload the fuze;

threading an outer adapter having an aft wall, an inner thread form, a center cavity, and an external mounting feature forward of said center cavity onto the inner adapter's outer thread form so that the aft wall contacts and preloads against the warhead aft of the inner adapter to position the fuze within the center cavity and position the external mounting feature forward of said fuze; and mounting a guidance system onto the external mounting feature.

20. The method of claim 19, wherein the fuze comprises one or more engagement surfaces positioned forward of its outer thread form, said inner adapter captured aft of said engagement surfaces, further comprising:

using a tool to engage the one or more engagement surfaces to torque the fuze into the warhead's inner thread form.

21. The method of claim 19, wherein said guidance system includes a first thread form and said outer adapter's external mounting feature comprises a second thread form, the step of mounting guidance system comprising threading the guidance system's first thread form into the outer adapter's second thread form.

* * * * *